US007299957B1

(12) United States Patent
Sutton

(10) Patent No.: US 7,299,957 B1
(45) Date of Patent: Nov. 27, 2007

(54) CLAMP-TYPE ARTICLE HANGER

(75) Inventor: Steven Sutton, Deal, NJ (US)

(73) Assignee: The Accessory Corp., New York, NY (US)

( * ) Notice: Subject to any disclaimer, the term of this patent is extended or adjusted under 35 U.S.C. 154(b) by 191 days.

(21) Appl. No.: 10/925,698

(22) Filed: Aug. 25, 2004

(51) Int. Cl.
*A41D 27/22* (2006.01)

(52) U.S. Cl. ..... 223/91; 223/95

(58) Field of Classification Search ..... 223/85–98
See application file for complete search history.

(56) References Cited

U.S. PATENT DOCUMENTS

| | | | | |
|---|---|---|---|---|
| D142,813 | S | 11/1945 | Andrews | D17/6 |
| 2,920,801 | A | 1/1960 | Batts | 223/96 |
| 2,950,939 | A | 8/1960 | Van Volkenburgh | 24/556 |
| 3,767,092 | A | 10/1973 | Garrison et al. | 223/96 |
| 4,194,274 | A | 3/1980 | Garrison | 24/248 |
| 5,020,705 | A | 6/1991 | Garrison | 223/96 |
| 5,170,916 | A | 12/1992 | Kolton et al. | 223/92 |
| 5,183,190 | A | 2/1993 | Zuckerman | 223/96 |
| 5,183,191 | A | 2/1993 | Garrison et al. | 223/96 |
| 5,297,706 | A | 3/1994 | Blitz | 223/96 |
| 5,361,948 | A | 11/1994 | Batts | 223/96 |
| 5,398,854 | A | 3/1995 | Blanchard | 223/96 |
| 5,692,806 | A | 12/1997 | Jones | 297/483 |
| 5,890,634 | A | 4/1999 | Zuckerman et al. | 223/96 |
| 6,199,728 | B1 | 3/2001 | Cohen | 223/96 |

*Primary Examiner*—Shaun R. Hurley
(74) *Attorney, Agent, or Firm*—Gordon & Jacobson, P.C.

(57) ABSTRACT

An article hanger including a body having at least one clamp. The clamp has first and second jaw members with opposed first and second gripping pads, respectively. The first gripping pad includes a first gripping surface that has a relief structure formed by projections that have a depth between 0.01 mm and 0.5 mm (and most preferably between 0.01 mm and 0.25 mm). The second gripping pad includes a second gripping surface that is substantially smooth. The projections of the relief structure may have pointed ends or planar end surfaces, and may be part of a texture or pattern (e.g., a pattern of cross-hatched grooves) that is imparted to the first gripping surface. The gripping pads of the jaw members are integrally formed therewith preferably with the same thermoplastic material or other suitable material. In the preferred embodiment, the hanger body is integrally formed together with at least one jaw member of the clamp(s) and its gripping pad.

16 Claims, 6 Drawing Sheets

FIG. 5
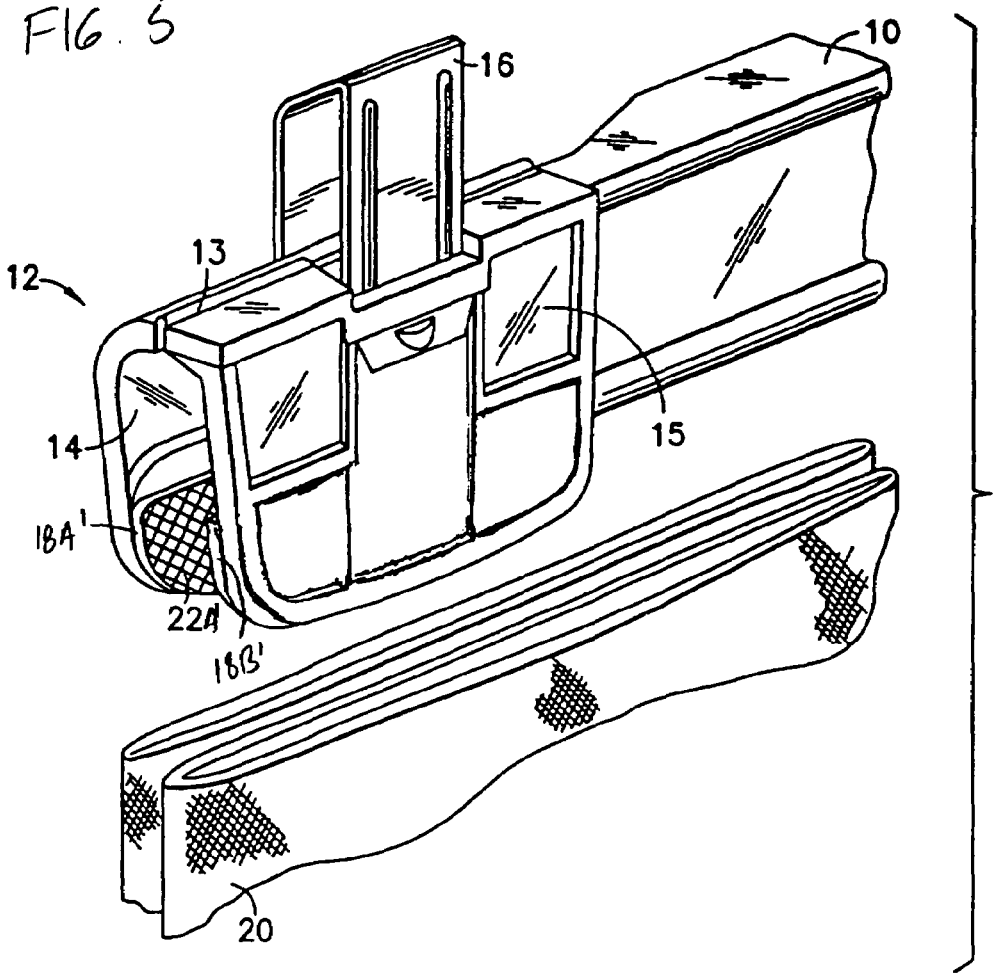
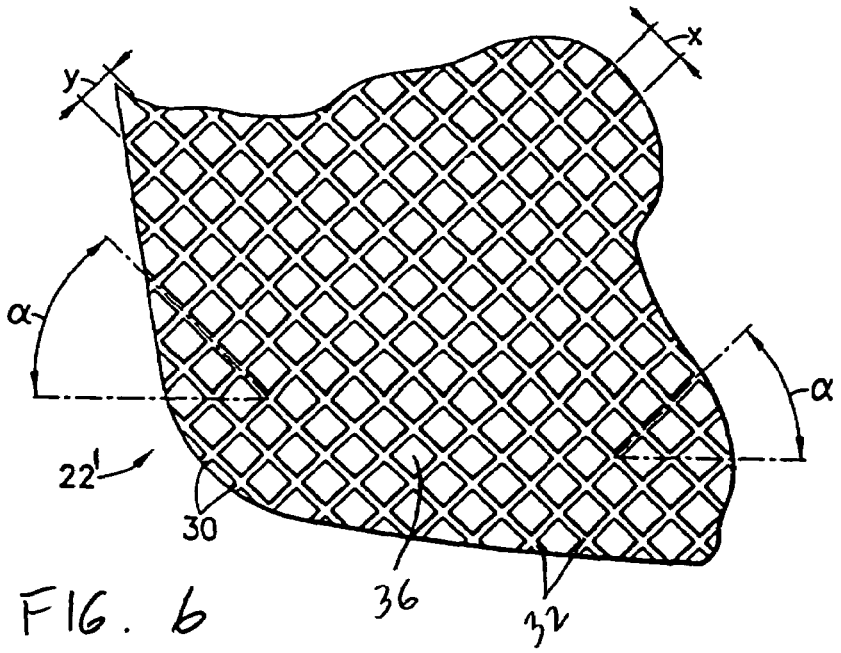
FIG. 6

CLAMP-TYPE ARTICLE HANGER

BACKGROUND OF THE INVENTION

1. Field of the Invention

The present invention relates to clamp-type article hangers.

2. State of the Art

Clamp-type hangers having at least one clamp are well-known for the suspension or hanging of garments (e.g., pants, skirts) or for other articles such as accessories (e.g., scarves, shawls), bedding (e.g., sheets), tablecloths, etc. Such hangers include at least one clamp typically defined by a pair of opposed clamp or jaw members between which the article is placed. Provision is made for biasing the members together to create the clamping force necessary to retain the article between the inner surfaces of the jaw members.

The "pinch-style" hanger is a variety of hanger that has a pair of opposed clamp or jaw members between which a portion of the article is secured. The jaw members are biased towards each other to create the clamping force necessary to retain an article between inner surfaces of the jaw members. Extending from the jaws are handle portions. By squeezing or pinching the handles toward one another, i.e., to reduce the space between the handles, the jaw members open to receive or release an article.

The "clip-style" clamp is a variety of clamp that has a pair of opposed clamp or jaw members between which a portion of the article is secured. The two jaw members are coupled by a hinged interface provided at or near the top edge of the two jaw members. A clip, which is typically c-shaped, slides over the top of the two jaw members. In a closed-position, the clip biases the jaw members towards each other to create the clamping force necessary to retain an article between inner surfaces of the jaw members. In order to remove an article held between the two jaw members, the clip is pulled upward such that the two jaw members are free to open relative to one another (about the hinged interface). In this position, the article can be easily removed from the jaw members.

To further retain the article between the inner surfaces of the members, the clamp or jaw members also have heretofore included on its inner surfaces teeth elements and/or a friction surface separately attached to the inner surfaces of the clamp or jaw members. For example, U.S. Pat. No. 4,194,274 to Garrison discloses a clamp-type article hanging device employing a spring-style clamp on which teeth 70 and 88 are placed to grip and secure the article to the hanger. Also, U.S. Pat. No. 3,767,092 to Garrison et al. discloses a clamping-type article hanging device employing a spring-style clamp on which teeth generally indicated as 42 are placed to secure the article to the hanger. These clamp-type article hangers which utilize teeth, often sharp or otherwise pointed, suffer from the drawback of introducing unwanted creases, marks, indentations, holes, projections or disfigurations to the article.

U.S. Pat. No. 5,183,191 to Garrison et al. discloses a clamp-type article hanging device utilizing pinch-style clamps on which a resilient pad is molded. The pad is adhered to or molded to the hanger by an expensive and complicated process whereby resilient friction material, when in a molten state, is applied to the inner surfaces of the jaw. Similarly, U.S. Pat. No. 5,020,705 to Garrison entitled discloses a clamp-type article hanging device employing spring-style clamps on which a gripping pad is separately attached to the hanger. This attaching process is also expensive and introduces undesirable complexities into the manufacturing process. Moreover, the material from which these gripping pads have been made have an unwanted tendency to become sticky when subject to increased temperatures. This can become particularly harmful to articles when hangers of this sort are used to transport articles over long distances, often in very hot conditions. Thus, articles may be damaged or otherwise harmed by use of such hangers heretofore in use.

U.S. Pat. No. 6,199,728 to Cohen and assigned to assignee of the present invention discloses a hanger employing clamps with opposing gripping pads integrally formed with the opposing jaw members. The gripping pads provide a gripping surface with a relief structure (e.g., texture or pattern formed on the gripping pad) that has a minimal elevational change. The relief structure provides an increased coefficient of friction that helps retain the article while also avoiding creases, marks, holes, projections, indentations or disfigurations to the article. However, in some applications (such as those where the article or a portion thereof is especially delicate or susceptible to creasing), the gripping pads on the two opposing jaw members of the clamp provide more friction than desired or necessary.

SUMMARY OF THE INVENTION

It is therefore an object of the invention to provide a clamp-type article hanging device which does not leave unwanted creases, imprints, indentations or other disfigurations on articles.

It is another object of the invention to provide a clamp-type article hanging device which can be used to support especially delicate articles without leaving unwanted disfigurations on the articles.

In accordance with the present invention, an article hanging device includes a body having at least one clamp. The clamp has first and second jaw members with opposed first and second gripping pads, respectively. The first gripping pad includes a first gripping surface that has a relief structure formed by projections that have a depth between 0.01 mm and 0.5 mm (and most preferably between 0.01 mm and 0.25 mm). The second gripping pad includes a second gripping surface that is substantially smooth. The gripping pads of the jaw members are integrally formed with the jaw member; i.e., they are preferably made from the same thermoplastic material or other suitable material. In the preferred embodiment, the hanger body is integrally formed together with at least one jaw member of the clamp(s) and its gripping pad.

According to one embodiment, the projections of the relief structure are part of a texture that is imparted to the first gripping surface.

According to another embodiment, the projections of the relief structure are part of a pattern (e.g., a pattern of cross-hatched grooves) that is imparted to the first gripping surface.

Additional objects and advantages of the invention will become apparent to those skilled in the art upon reference to the detailed description taken in conjunction with the provided figures.

BRIEF DESCRIPTION OF THE DRAWINGS

FIG. 5 is a partial perspective view of the clamp-type article hanger of FIG. 4.

FIG. 6 is a partial view of the patterned gripping surface of the clamp-type hanger of FIG. 4.

DETAILED DESCRIPTION OF THE PREFERRED EMBODIMENTS

Figure 1:
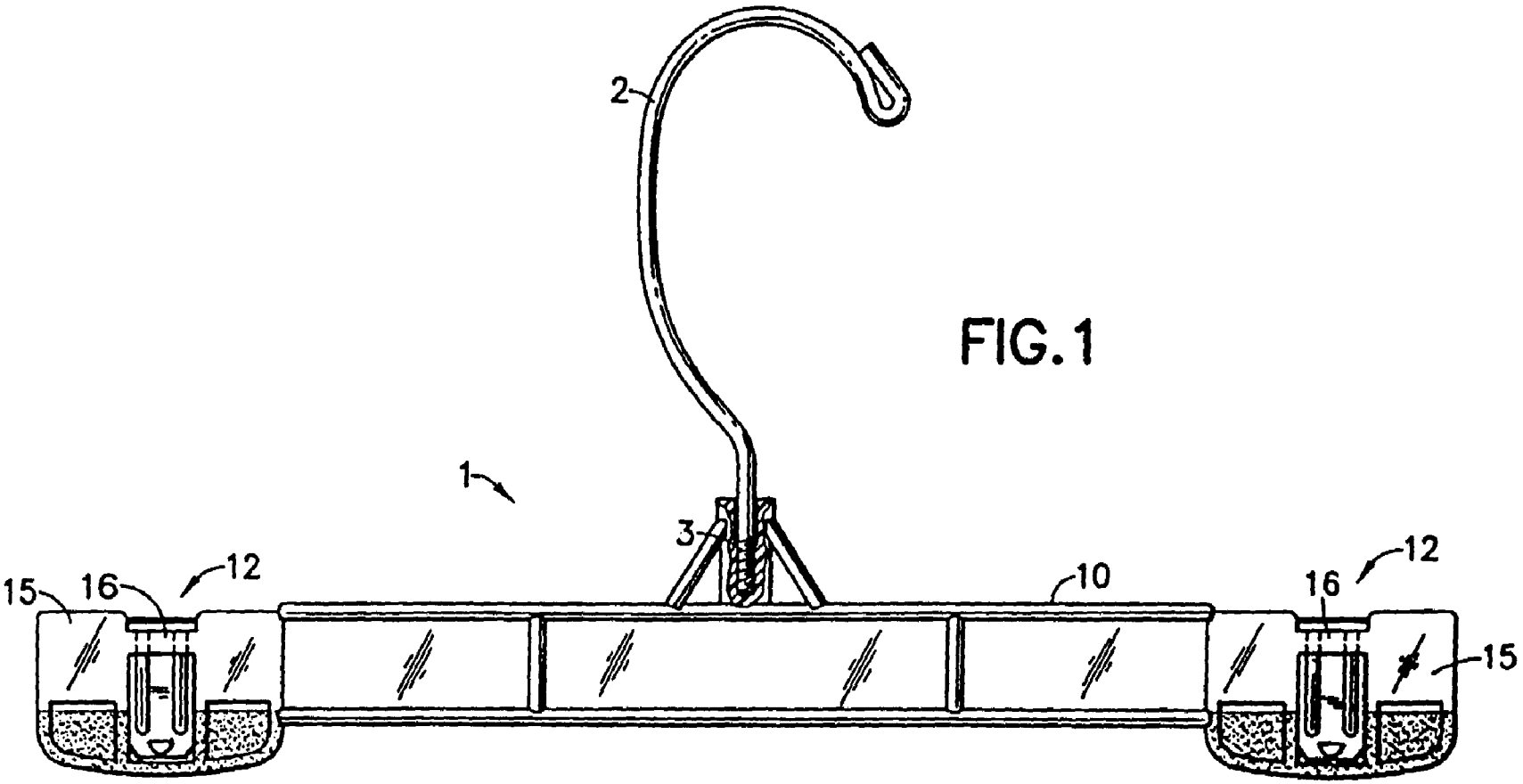
FIG. 1 is a rear view of a first embodiment of a clamp-type article hanger in accordance with the present invention.

Referring now to FIG. 1, a clamp-type article hanger 1 in accordance with the present invention is shown. Clamp-type article hanger 1 includes a partial loop or hook member 2, which may be formed from plastic, a metal wire or any other appropriate material. The partial loop or hook member 2 may be secured via threads 3 to body 10, as shown, or may be integrally formed from the same material as body 10.

Clamp-type article hanger 1 has a body 10, and end clamps generally indicated as Clamps 12 may be formed from the same material as body 10, and may also be molded or otherwise formed integrally with body 10. It is noted that, although shown with clamp 12 at each of its ends, the present invention recognizes that only one clamp 12 or more than two clamps 12 may be used.

Figure 2:
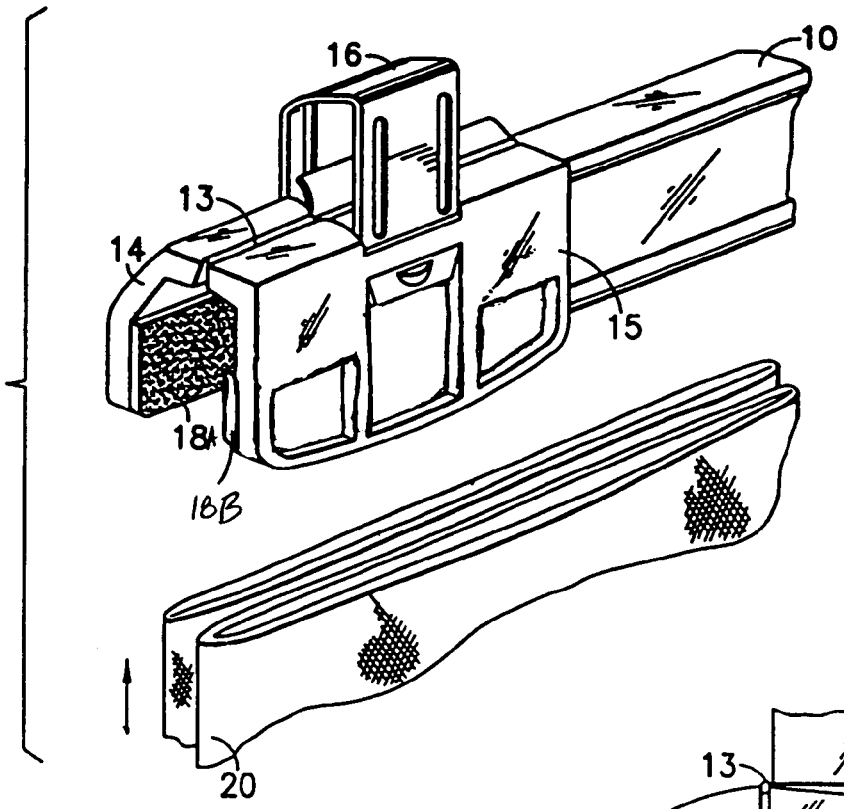
FIG. 2 is a partial perspective view of the clamp-type article hanger of FIG. 1.
Figure 3:
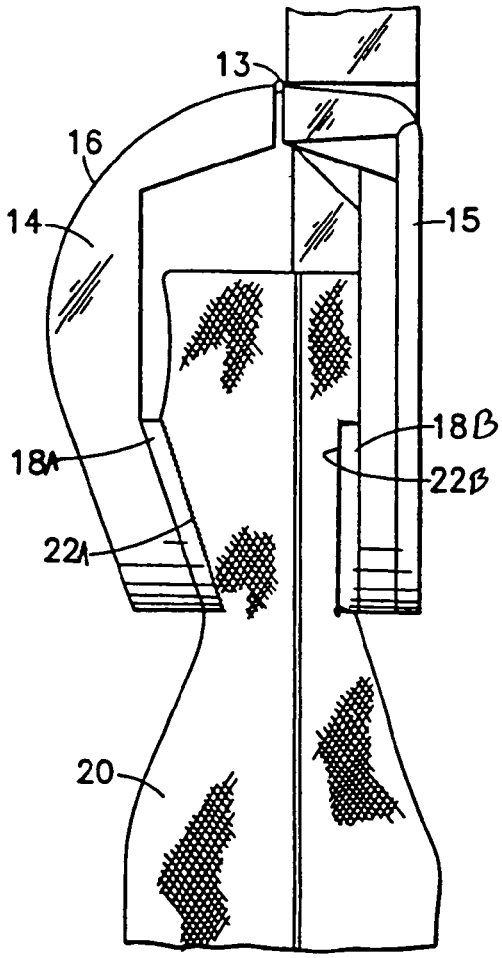
FIG. 3 is a side view of the clamp-type hanger of FIG. 1.

As best shown in FIGS. 2 and 3, clamp 12 has along its upper edge a live hinge Clamp 12 includes a front jaw member 14 and a rear jaw member 15. The jaw members 14 and 15 have opposed gripping pads 18A and 18B that project from interior surfaces of the respective jaw member. The gripping pads 18A, 18B, in turn, include opposed gripping surfaces 22A, 22B. One of the gripping surfaces 22A is textured with a minimal relief. The other gripping surface 22B is substantially smooth. The textured gripping surface 22A provides an increased coefficient of friction that helps retain the article. Likewise, the difference in the coefficients of friction between the gripping surfaces 22A, 22B tends to help in the gripping of the article. The textured gripping surface 22A as well as the substantially smooth gripping surface 22B avoid creases, marks, holes, projections, indentations or disfigurations on the fabrics of articles held therein.

The shape and depth (which is the distance between the top point and bottom point) of the projections of the textured gripping surface 22A can be varied to accommodate different fabrics, and to vary the coefficient of friction provided by the gripping surface 22A. In the preferred embodiment, the depth of the projections of the textured gripping surface 22A is in a range between 0.01 mm to 0.50 mm, and preferably is no greater than 0.25 mm for delicate fabrics. The peaks of the projections of the textured surface may be truncated or blunted such that a planar portion of textures gripping surface 22A is provided for contacting the fabric 20. In addition, the smooth gripping surface 22B preferably has minimal surface variations. If any surface variations are present in the gripping surface 22B, such variations are preferably limited to a depth less than 0.01 mm.

The elements of clamp 12, namely, hinge 13, jaw members 14 and 15, gripping pads 18A, 18B and gripping surfaces 22A, 22B are preferably integrally formed. That is, these elements of clamp 12 are all formed, for example, by injection molding in one piece from a substantially identical material or materials. However, separate molded or extruded pieces may be used. The presently preferred embodiment contemplates that the material(s) of the elements of the clamp 12 may include polystyrene, polypropylene, polyethylene, styrene-butadiene copolymers and blends, or polycarbonates. The textured gripping surface 22A is preferably realized by treating the mold cavity surface that forms the textured surface 22A by engraving, acid etching, electrical discharge machining, vapor honing, or sandblasting to provide a texture or pattern to enhance the coefficient of friction. The texture or pattern may take on a random form or may be uniform in nature. In either case, the pattern or texture of the surface 22A should have a minimal relief structure so that damage or undesired effects to the fabric of articles clamped in the hanger, particularly delicate fabrics, is minimized or eliminated.

Front jaw member 14 is capable of pivoting about hinge 13, while rear jaw member 15 is stationary with respect to hinge 13. Clamp 12 also includes a biasing clip which may be formed from a metal or any other appropriate material. Biasing clip 16, although part of clamp 12, is not integrally formed with clamp 12. As best shown in FIGS. 2 and 3, biasing clip 16 is positioned above hinge 13, and has two legs which respectively abut the front and rear jaw members 14 and 15, respectively.

Figure 4:
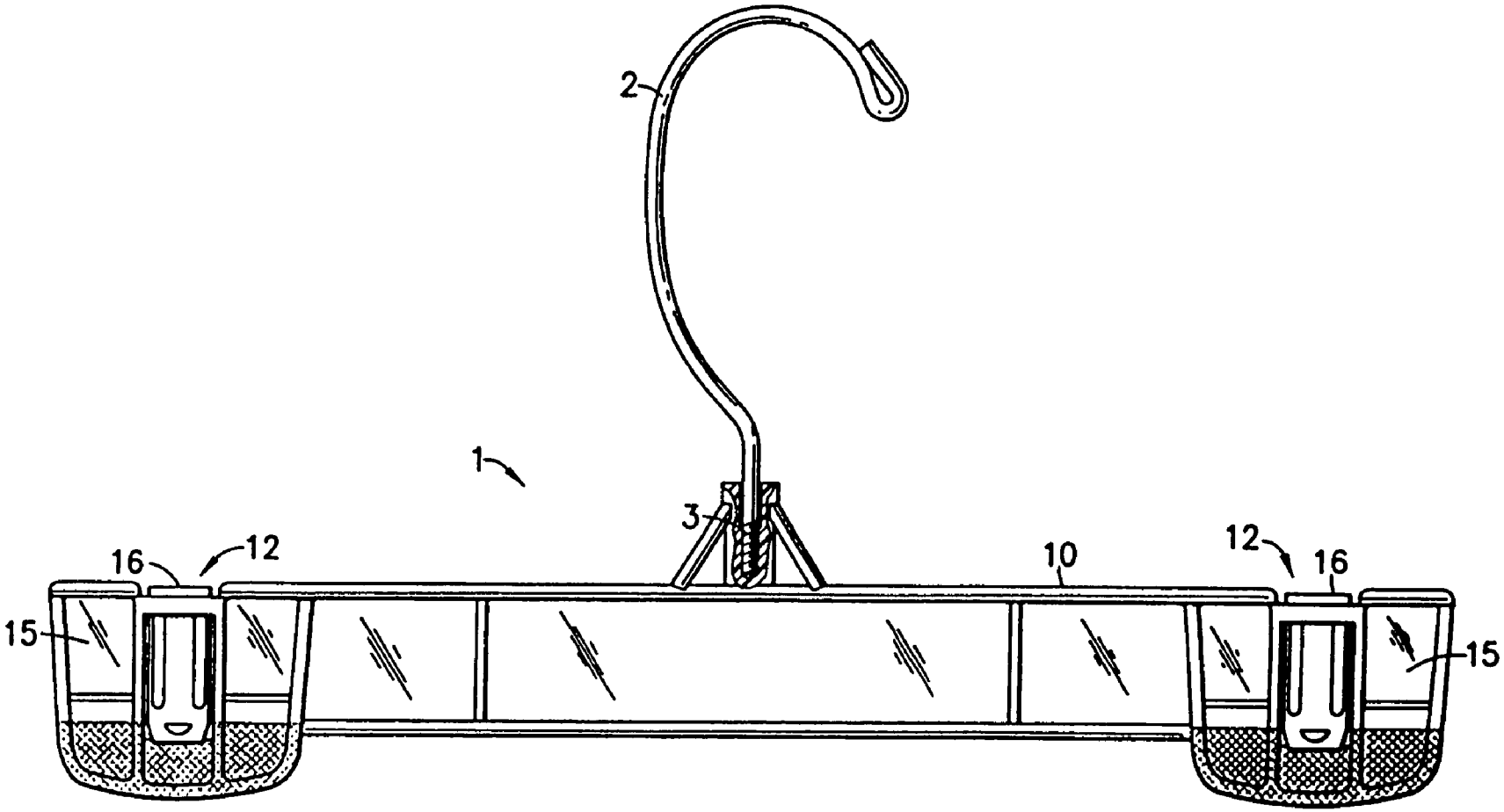
FIG. 4 is a rear view of a second embodiment of a clamp-type article hanger in accordance with the present invention.

Clamp 12 may occupy a closed position when biasing clip 16 is in its vertically lowered position, as shown in FIGS. 2 and 4. In this position, the legs of biasing clip 16, and more particularly the leg which abuts front jaw member 14, is lowered such that front jaw member 14 may not pivot about hinge 13. In this closed position, gripping members 18 via opposed gripping surfaces 22 serve to secure and support article 20.

To release article 20, the jaw members are moved to an open position. Specifically, to achieve this open position, biasing clip 16 is moved to its raised position, as shown in FIG. 3, such that front jaw member 14 may pivot about axis 13 away from rear jaw member 15.

FIG. 4 illustrates an alternate embodiment of an article hanger according to the present invention wherein the relief structure of the gripping surface 22A has a "cross-hatch" or "diamond" pattern. As shown in FIG. 6, the preferred pattern of the relief structure includes a first set of parallel grooves 30 with an interval x between the grooves 30 and a second set of parallel grooves 32 with an interval y between the grooves 32. In this configurations the grooves 30, 32 form diamond-shaped projections 36. The preferred interval for each of x and y is equal, and falls within a range of 0.1 to 1.0 mm, with each interval preferably having a measurement of approximately 0.5 mm. The diamond shape of the projections 36 may be altered by varying an angle $\alpha$ of the grooves 30, 32 relative to a horizontal axis drawn through horizontally opposite corners of the diamond shape of projections 36. The angle $\alpha$ is preferably 30°.

The shape and depth (which is the distance between the top point and bottom point) of the projections of the patterned gripping surface 22A' can be varied to accommodate different fabrics, and to vary the coefficient of friction provided by the gripping surface 22A'. In the preferred embodiment, the depth of the projections of the patterned gripping surface 22A' is in a range between 0.01 mm to 0.50 mm, and preferably is no greater than 0.25 mm for delicate fabrics. The peaks of the projections of the patterned surface may be truncated or blunted such that a planar portion of patterned gripping surface 22A' is provided for contacting the fabric 20. In addition, the smooth gripping surface 22B' on the gripping pad 18B' preferably has minimal surface variations. If any surface variations are present in the gripping surface 22B', such variations are preferably limited to a depth less than 0.01 mm.

The elements of clamp 12, namely, hinge 13, jaw members 14 and 15, gripping pads 18A', 18B' and gripping surfaces 22A', 22B' are preferably integrally formed. That is, these elements of clamp 12 are all formed, for example, by injection molding in one piece from a substantially identical material or materials. However, separate molded or extruded pieces may be used. The presently preferred embodiment contemplates that the material(s) of the elements of the clamp 12 may include polystyrene, polypropylene, polyethylene, styrene-butadiene copolymers and blends, or polycarbonates. The patterned gripping surface 22A' is preferably realized by treating the mold cavity surface that forms the patterned surface 22A' by engraving, acid etching, electrical discharge machining, vapor honing, or sandblasting to provide the pattern that enhances the coefficient of friction.

Figure 7:
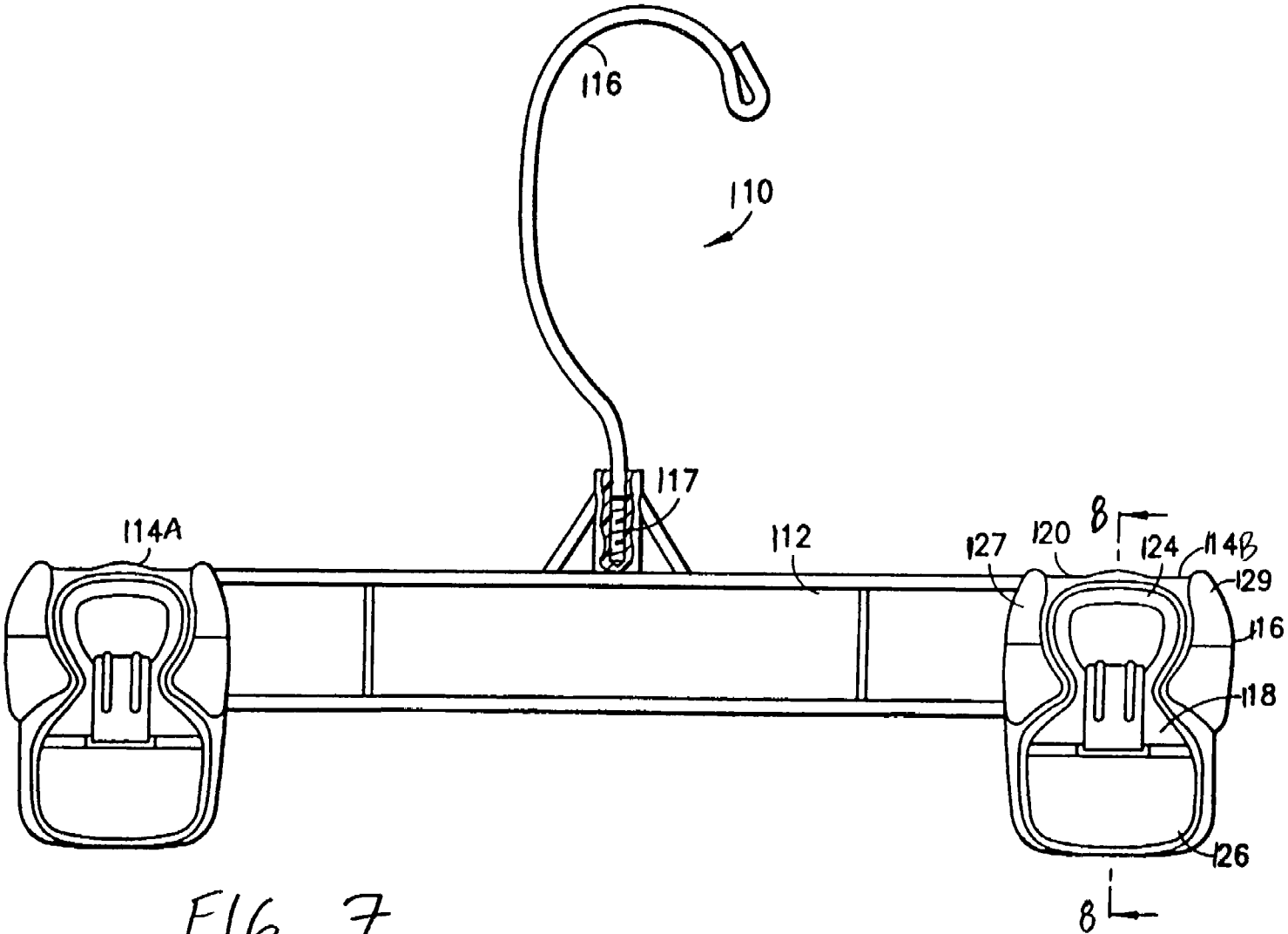
FIG. 7 is a front view of a third embodiment of a clamp-type article hanger in accordance with the present invention.

FIG. 7 illustrates another embodiment of an article hanger 110 in accordance with the present invention, including a hanger body 112 having pinch-type clamps 114A and 114B at its ends. Article hanger 110 includes a partial loop or hook member 116, which may be formed from plastic or metal wire or any other appropriate material. The partial loop or hook member may be secured via threads 117 to the body 112, as shown, or may be integrally formed from the same material as body 112, or may be connected to the body in any other manner. The body 112 and the clamps 114A, 1141B are preferably made from the same material, which may comprise any number of well known plastic or resin materials, such as "k"-resin, polystyrene, polypropylene, polyethylene, styrene-butadiene copolymers and blends, polycarbonates, and combinations thereof.

Figure 8B:
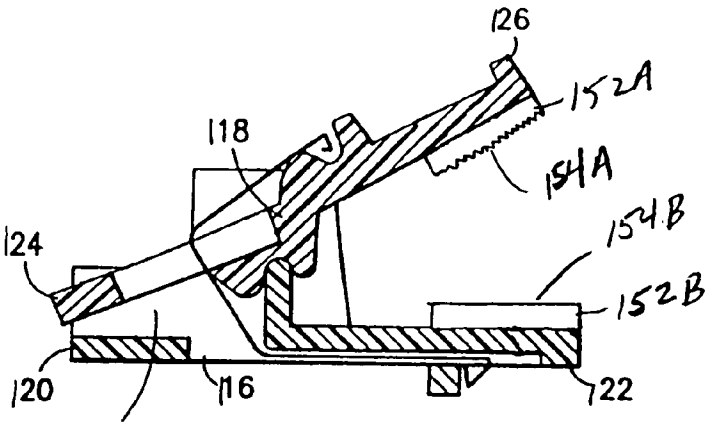
FIGS. 8A, 8B and 8C are sectional views along line 8—8 of the exemplary clamp of the article hanger of FIG. 7, with FIG. 8A showing the clamp with its jaw members in a fully closed position, FIG. 8B showing the clamp with its jaw members in a fully open position, and FIG. 8C showing the clamp with its jaw members shown closed on a portion of an article.
Figure 8A:
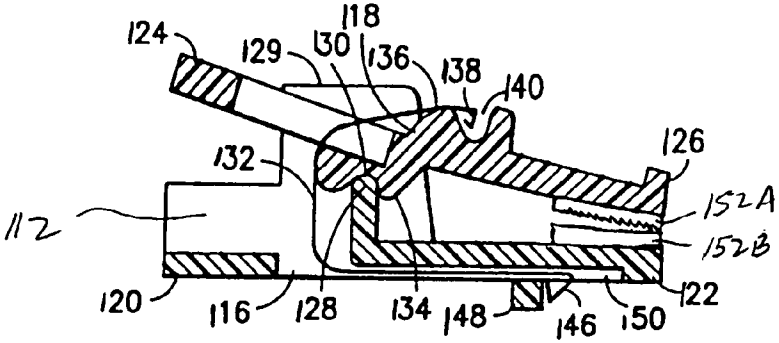
Figure 8C:
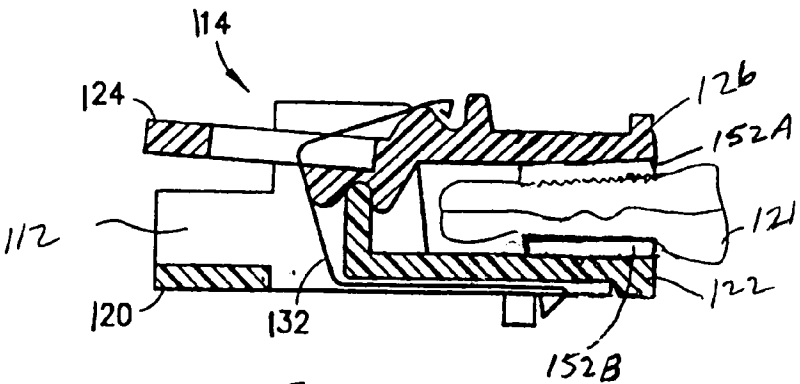

Referring now to FIGS. 8A through 8C, the clamps 114A, 1141B (collectively, 114) each have a back base member 116 which is preferably integrally formed with the body 112, and a front lever member 118 movable relative thereto. The base member 116 includes a handle portion 120 and a jaw end 122, and the lever member 118 includes a handle portion 124 which is opposite handle portion 120, and a jaw end 126 which is positioned opposite jaw end 122. The lever member 118 is pivotally supported on the base member 116 along a pivot wall 128 extending between two supports 127, 129 (FIG. 7) on the base member 116. The pivot wall 128 is received in a pivot groove 130 on the back of lever member 118. A C-shaped spring clip 132, preferably made of metal or plastic, is dimensioned to receive a portion of the base member 116 and a portion of the lever member 118 and is positioned over those portions such that facing inner surfaces of the spring clip 132 bear against outwardly facing surfaces 134, 136 of the base member 116 and the lever member 118, respectively. A front end of the spring clip 132 has a flange 138 that engages within an aperture 140 in the lever member 118 to secure the spring clip 132 to the lever member. A rear end of the spring clip 132 has a tab 146 which engages a strut 148 spanning an aperture 150 in the base member 116 to secure the spring clip to the base member. The spring clip 132 urges the lever member jaw end 126 towards the base member jaw end 122.

The jaw members 122 and 126 have opposed gripping pads 152A and 152B that project from interior surfaces of the respective jaw member. The gripping pads 152A, 152B, in turn, include opposed gripping surfaces 154A, 154B. One of the gripping surfaces 154B is substantially smooth. The other gripping surface 154A is textured with a minimal relief. The textured gripping surface 154A provides an increased coefficient of friction that helps retain the article 121 as shown in FIG. 8C. The textured gripping surface 154A as well as the substantially smooth gripping surface 154B avoid creases, marks, holes, projections, indentations or disfigurations on the fabrics of articles held therein. The gripping surfaces 154A, 154B can readily be adapted to include the features described above with respect to the gripping surfaces 22A and 22B of FIGS. 1–3. Alternatively, the gripping surfaces 154A, 154B can readily be adapted to include the features described above with respect to the gripping surfaces 22A' and 22B' of FIGS. 4–6.

The article hangers of the present invention as described herein have the advantage of providing a clamping surface which does not harm the fabric of the article. The article hangers are suitable for the suspension or hanging of garments (e.g., pants, skirts) or for other articles such as accessories (e.g., scarves, shawls), bedding (e.g., sheets), tablecloths, etc. If the article hanger is to be used to support an especially delicate article, the smooth gripping surface of the hanger can be used to contact the especially delicate fabric and thereby minimize the disfigurations on that fabric. Also, because the jaw members, the gripping pads and the gripping surfaces are all preferably formed from the same material by, for example, injection molding in one piece, reduced manufacturing costs may be provided as compared to prior art clamp-type hangers with gripping mechanisms integral thereto. However, while less preferred, the gripping surfaces can be made from separate pieces of material, and glued or otherwise attached (e.g., via a snap-fit, or otherwise) to the jaw members.

There have been described and illustrated herein embodiments of clamp for a reusable article hanging device. While particular embodiments of the invention have been described, it is not intended that the invention be limited thereto, as it is intended that the invention be as broad in scope as the art will allow and that the specification be read likewise. Thus, while particular article clamping mechanisms have been disclosed, it will be appreciated other clamp mechanisms may be used. In addition, while the clamp is shown securely attached to the hanger body as an integral part of hanger body, it will be understood that this attachment method is merely illustrative of the most cost effective method of manufacturing a sturdy, attractive hanger. Furthermore, the clamp may alternatively be made separately from a material that is the same or different from the material of hanger body, and may be fixedly or movably attached to the hanger body by known means or methods. Moreover, the clamp may also be attached to hanger body by one or more intervening elements, such as, for example, a bar or rod (not shown) supported below the hanger body. In addition, while straight crossbar members are shown, it will be appreciated that the shape of article hangers of the present invention are intended to be broad and include cross members which are curved or otherwise shaped. It will therefore be appreciated by those skilled in the art that yet other modifications could be made to the provided invention without deviating from its spirit and scope as claimed.

What is claimed is:

1. A clamp-type article hanger for holding an article, comprising:

a body having at least one clamp, said clamp having first and second jaw members with opposed first and second gripping pads, respectively, wherein said first gripping pad includes a first gripping surface that has a relief structure formed by projections that have a depth between 0.01 mm and 0.5 mm, and said second gripping pad includes a second gripping surface that is substantially smooth having at most minimal surface variations which are limited to a depth of less than 0.01 mm.

2. A clamp-type article hanger according to claim 1, wherein:

said projections have a depth between 0.01 mm and 0.25 mm.

3. A clamp-type article hanger according to claim 1, wherein:

at least one of said first and second jaw members and its respective gripping pad are integrally formed together.

4. A clamp-type article hanger according to claim 1, wherein:

said projections have planar end surfaces.

5. A clamp-type article hanger according to claim 1, wherein:

said projections are part of a texture imparted to said first gripping surface.

6. A clamp-type article hanger according to claim 1, wherein:

said projections are part of a pattern imparted on said first gripping surface.

7. A clamp-type article hanger according to claim 6, wherein:

said pattern is defined by a plurality of cross-hatched grooves defined in said first gripping surface.

8. A clamp-type article hanger according to claim 7, wherein:

said grooves include a first plurality of parallel grooves transversely oriented to a second plurality of parallel grooves.

9. A clamp-type article hanger according to claim 8, wherein:

said grooves defined diamond-shaped projections.

10. A clamp-type article hanger according to claim 9, wherein:

said diamond-shaped projections have planar ends.

11. A clamp-type article hanger according to claim 6, wherein:

said grooves have a depth between 0.01 mm and 0.25 mm.

12. A clamp-type article hanger according to claim 6, wherein:

said grooves are spaced apart at 0.1 mm to 1.0 mm intervals along said first gripping surface.

13. A clamp-type article hanger according to claim 1, wherein:

one of said first and second jaw members is pivotable relative to the other of said first and second jaw members.

14. A clamp-type article hanger according to claim 1, wherein:

said body, said first and second jaw members, and said first and second gripping pads are integrally formed with substantially identical material.

15. A clamp-type article hanger according to claim 14, wherein:

said material is selected from the group consisting of polystyrene, polypropylene, polyethylene, styrene butadiene copolymers and blends, or polycarbonates.

16. A clamp-type article hanger according to claim 14, wherein:

said body, said first and second jaw members, and said first and second gripping pads are formed by injection molding.

* * * * *